US005163683A

United States Patent [19]

Oswald

[11] Patent Number: 5,163,683

[45] Date of Patent: Nov. 17, 1992

[54] GOLF PARK

[76] Inventor: Gordon Oswald, 6211 Oakbrook Cir., Huntington Beach, Calif. 92648

[21] Appl. No.: 764,791

[22] Filed: Sep. 24, 1991

Related U.S. Application Data

[60] Division of Ser. No. 546,039, Jun. 28, 1990, Pat. No. 5,112,054, and a continuation-in-part of Ser. No. 493,910, Mar. 15, 1990, abandoned.

[51] Int. Cl.[5] ..... A63B 69/36

[52] U.S. Cl. ..... 273/176 R; 273/176 A; 273/DIG. 23

[58] Field of Search ..... 273/176 R, 176 A, 176 AA, 273/176 AB, 32 R, 87 R, 87 C, 245, 277, DIG. 23, 176 G, 176 E

[56] References Cited

U.S. PATENT DOCUMENTS

| | | | |
|---|---|---|---|
| 1,851,423 | 3/1932 | Ely | 273/176 A |
| 2,003,074 | 5/1935 | Gage | 273/176 A |
| 2,248,053 | 7/1941 | Bales | 273/176 A |
| 2,482,210 | 9/1949 | Reach et al. | 273/176 A |
| 3,083,021 | 3/1963 | Reilly | 273/176 AB |
| 3,599,980 | 8/1971 | Harmond | 273/176 A |
| 3,649,027 | 3/1972 | Vallas | 273/176 A |
| 3,685,832 | 8/1972 | Johnson | 273/176 A |
| 3,695,619 | 10/1972 | Brobston | 273/176 A |
| 4,145,053 | 3/1979 | Healey | 273/176 A X |
| 4,225,136 | 9/1980 | Beam | 273/176 AB |
| 4,798,385 | 1/1989 | Tegart | 273/176 A |
| 4,928,973 | 5/1990 | Perry et al. | 273/176 R X |

*Primary Examiner*—Paul E. Shapiro
*Assistant Examiner*—Sebastiano Passaniti
*Attorney, Agent, or Firm*—Price, Gess & Ubell

[57] ABSTRACT

An improved compact golf course simulates, with great realism, the drive, approach, chipping, and putting of a golf game played on a full scale course. The compact course provides the player with at least nine distinct target greens for his approach shot, each green having different sand or water hazards. The course provides the player with a plurality of chipping greens that may be played from the drive area. A common putting green containing nine holes is used to putt-out after the drives and approach shots have all been played out on the nine target greens. The target greens are designed to automatically clear balls from their surface. All drive, approach, and chip shots are taken from a common, relatively compact area. In an alternate preferred embodiment, distinctly marked putting zones are provided on the target greens and the chipping greens and for each of the holes on the common putting green.

9 Claims, 6 Drawing Sheets

| LAYER | HOLE | 1 | 2 | 3 | 4 | 5 | 6 | 7 | 8 | 9 | TOTAL |
|---|---|---|---|---|---|---|---|---|---|---|---|
| | PAR | 4 | 4 | 5 | 4 | 5 | 3 | 4 | 3 | 4 | |
| | YARDAGE | | | | | | | | | | 135 |
| 117 | DRIVE | | 125 | | | | | 134 | | | 137 |
| | APPROACH | | 127 | | | | | 133 | | | 139 |
| | PUTTS | | 129 | | | | | | | | 141 |
| | TOTAL | | 131 | | | | | | | | |
| 119 | DRIVE | | | | | | | | | | |
| | APPROACH | | | | | | | | | | |
| | PUTTS | | | | | | | | | | |
| | TOTAL | | | | | | | | | | |
| 121 | DRIVE | | | | | | | | | | |
| | APPROACH | | | | | | | | | | |
| | PUTTS | | | | | | | | | | |
| | TOTAL | | | | | | | | | | |
| 123 | DRIVE | | | | | | | | | | |
| | APPROACH | | | | | | | | | | |
| | PUTTS | | | | | | | | | | |
| | TOTAL | | | | | | | | | | |

115

FIG. 2

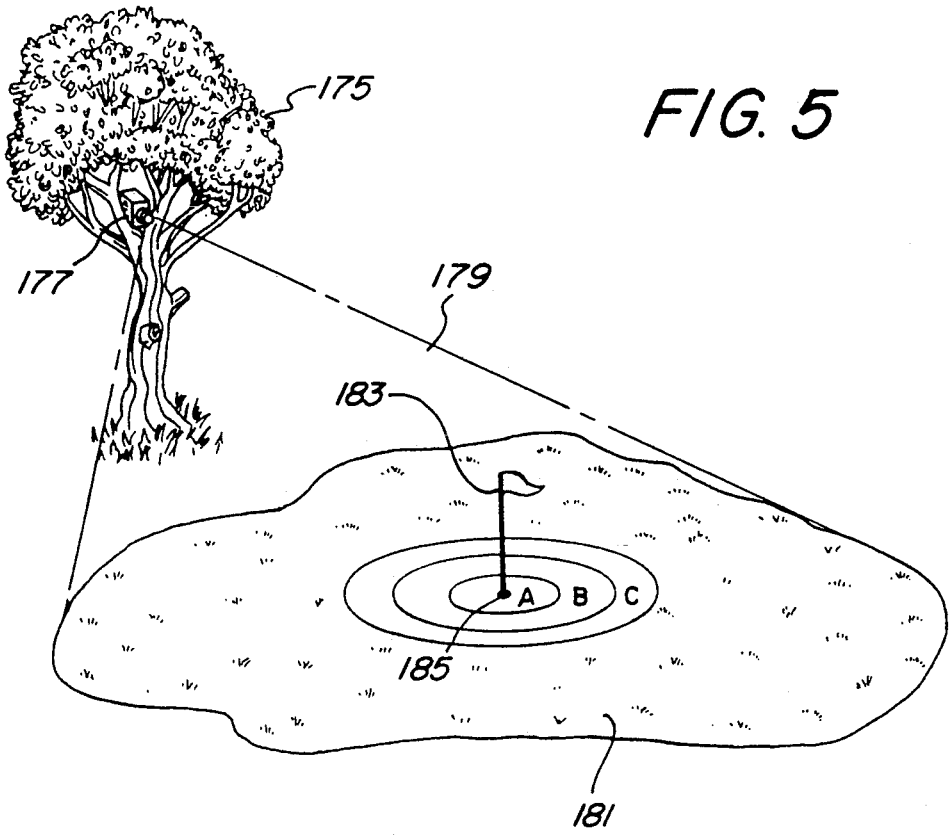
FIG. 5
FIG. 6
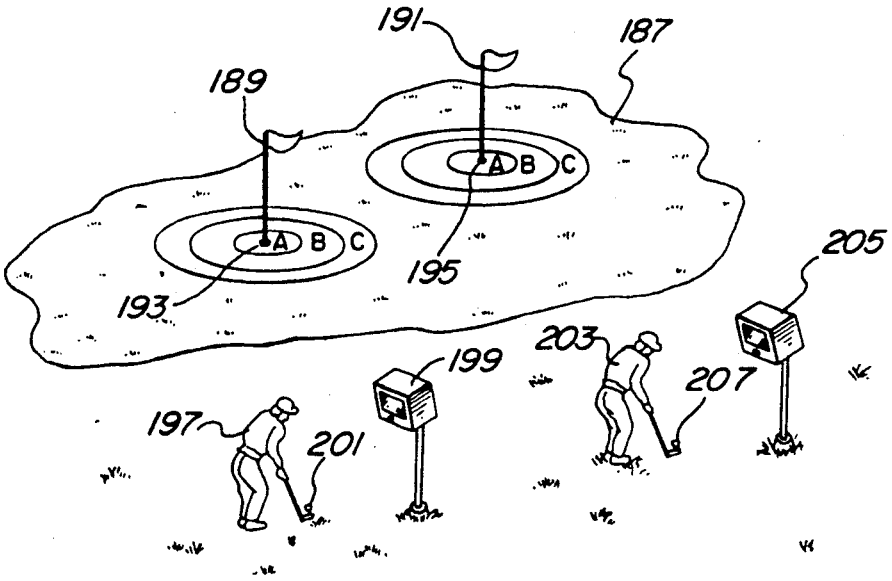

GOLF PARK

CROSS-REFERENCE TO RELATED APPLICATIONS

This is a division of U.S. patent application Ser. No. 07/546,039, filed on Jun. 28, 1990, now U.S. Pat. No. 5,112,054 and a continuation in part of Ser. No. 07/493,910, filed Mar. 15, 1990, abandoned for The Golf Park.

FIELD OF THE INVENTION

The present invention relates to an improved game and, more particularly, pertains to a new and improved compact golf course and a golf course game.

DESCRIPTION OF RELATED ART

The game of golf was developed to be played on 18 successive golf fields, each field consisting of a tee area, fairway, and a pole or cup situated on a green circular area of special grass, which is cut to allow the ball to be rolled into the cup. The field is also filled with hazards such as sand traps, water areas, trees, and long grass, weeds, or rocks, normally referred to as "rough." The ball used is made of a special hard covering and is approximately 1½ inches in diameter. A variety of clubs varying in size and shape are used to stroke or propel the ball a desired distance. A putting mallet is also used for rolling the ball, once on the green, into the cup. Strokes are recorded at the end of play for each hole and added together at the end of 9 and at the end of 18 holes. After each stroke is hit, the player must follow the ball and hit it again until all 18 holes are played consecutively.

Each hole is assigned a number of strokes, which a successful player would take to put the ball in the cup. This number is referred to as "par" and, for example, may be either 3, 4, or 5, or some other number, depending on the distance between the tee area and the green, and the hazards associated with the hole.

Although golf has been very well received and is a popular game, certain problems exist that have led to the creation of compact golf courses. The major problems associated with the golf game are the amount of land and space necessary to provide a field for play, the cost of maintaining such a large land area, the consequent ground and water pollution caused by chemicals and fertilizers used to maintain the vast fields of play, and the length of time necessary to play one game. All these problems cause golf courses to be unavailable to the general public in many areas. To partially alleviate this condition, practice ranges have been built to allow a player to hit a container of balls into a field. Some of these practice ranges have been equipped with green areas, flags, and sand traps, etc., to provide the player with a chance to hit at a variety of targets.

The present invention takes the golf game concept and the driving range concept and combines them into an integrated new golf game with its own set of rules and procedures to provide the player with easier access to competitive play on a compact golf course.

SUMMARY OF THE INVENTION

A compact golf course is provided on an elongated fan-shaped area of land. The common ball hitting area for all shots is located at the apex of the fan. At least nine target greens with sand and/or water hazards are located at various distances from the ball hitting area within the boundaries of the course. Drive target areas are located in a central fairway area of the course. A plurality of chipping greens is located adjacent to the common ball hitting area. A player may chip to the respective green from grass or a sand hazard located in the ball hitting area. After all drives and approach shots are completed for nine holes, the player will putt out all nine separate pins and cups at various distances and locations from a centrally-located start area. All the target greens are slanted to provide self-clearing of golf balls that land on them. In alternate preferred embodiment, all the target greens, chipping greens and all the pins of the common putting green are marked into distinct putting zones which range outwardly from the cup.

BRIEF DESCRIPTION OF THE DRAWINGS

The exact nature of this invention, as well as the general objects and advantages thereof, will become readily apparent with consideration of the following specification as related to the accompanying drawings, in which like reference numerals designate like parts throughout the figures thereof, and wherein:

FIG. 2 is a diagram of a scorecard used according to the rules of the present invention;

FIG. 5 is a perspective illustration of a target green showing distinct putting zones ranging outwardly from the cup on that green.

FIG. 6 is a perspective illustration showing the tee area and the chipping greens in an alternate preferred embodiment wherein the chipping greens are marked into distinct putting zones ranging from the cup outwards.

DESCRIPTION OF THE PREFERRED EMBODIMENTS

Figure 1:
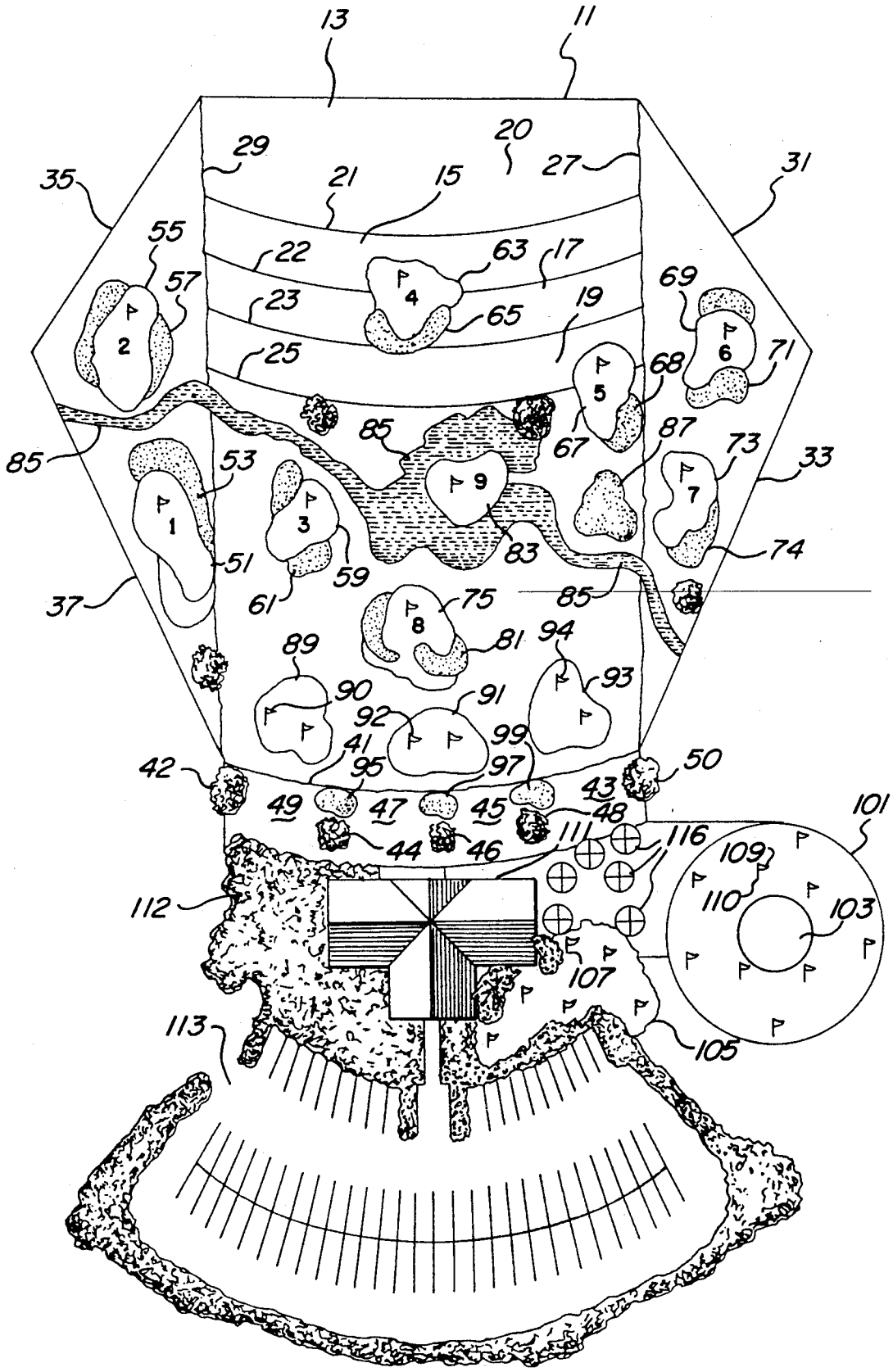
FIG. 1 is a plan view illustrating a preferred layout of a compact golf course according to the present invention.

FIG. 1 illustrates a preferred layout of a compact golf park according to the present invention. The ball playing area is roughly fan-shaped, bound on the extreme far end by out-of-bounds boundary 11, on the right side by boundaries 31 and 33, and on the left side by boundaries 35 and 37. At the end of the play area nearest the clubhouse 111 is a ball hitting or tee area 41.

In order to create the feeling of a country club atmosphere, the clubhouse 111 is appropriately landscaped 112, as is the surrounding parking area 113. A practice putting area 105 is provided next to the clubhouse 111 with a variety of pins and cups 107. Outside tables 116 with umbrellas, etc., may be located on a patio area next to the clubhouse 111, which is also adjacent to the common green 101 for the compact course.

The ball hitting area 41 is preferably made up of several sections 49, 47, 45 and 43, which are separated by appropriate landscaping, trees and flowers, 42, 44, 46, 48 and 50, for example. Located adjacent to these ball hitting sections within the ball hitting area 41 are a plurality of sand traps 95, 97 and 99. The purpose of these sand traps will be explained hereinafter.

The compact course itself consists of a central area 13, which is bound by boundary 27 on the right and boundary 29 on the left, to define a fairway. The fairway area 13 is marked by colorful boundary lines 21, 22, 23 and 25, creating four different landing areas 19, 17, 15 and 20. Landing area 19 is obviously closer to the ball hitting area 41 than landing area 20. The various landing areas define driving distances for various levels of play. Landing area 19 is the driving distance for women golfers. Landing area 17 is the driving distance for men golfers. Landing area 15 is the driving distance for professional golfers. Landing area 20 is the driving distance for championship golfers.

Located within the boundaries of the compact course are nine target greens, defining nine holes of play. The first target green 51 is hole #1. The second target green 55 is hole #2. The third target green 59 is hole #3. The fourth target green 63 is hole #4. The fifth target green 67 is hole #5. The sixth target green 69 us hole #6. The seventh target green 73 is hole #7. The eighth target green 75 is hole #8. The ninth target green 83 is hole #9. It will be noted that each green has a hazard associated therewith. For example, green 51 has a sand hazard 53. Green 55 has a sand hazard 57. Green 59 has a sand hazard 61. Green 63 has a sand hazard 65. Green 67 has a sand hazard 68. Green 69 has a sand hazard 71. Green 73 has a sand hazard 74. Adjacent to green 73 is another sand hazard 37. Green 75 has a sand hazard 81. Green 83 (hole #9 in this instance) has a water hazard 85, which not only surrounds the entire green 83, but runs the width of the course itself. In addition to these hazards, a variety of trees and shrubs are located throughout the course. Thus, it can be seen that the look and feel of the compact course of the present invention is quite similar to that of a full size golf course.

Located close to the ball hitting area 41 is a plurality of chipping greens 89, 91 and 93. Each green may have more than one flag and cup. Chipping green 89 has flags 90. Chipping green 91 has flags 92. Chipping green 93 has flags 94.

The common putting green 101 is preferably circular, having a circular central area 103 which constitutes the start of putt area for the nine pins 109 and cups 110 located on the green 101.

Figure 3:
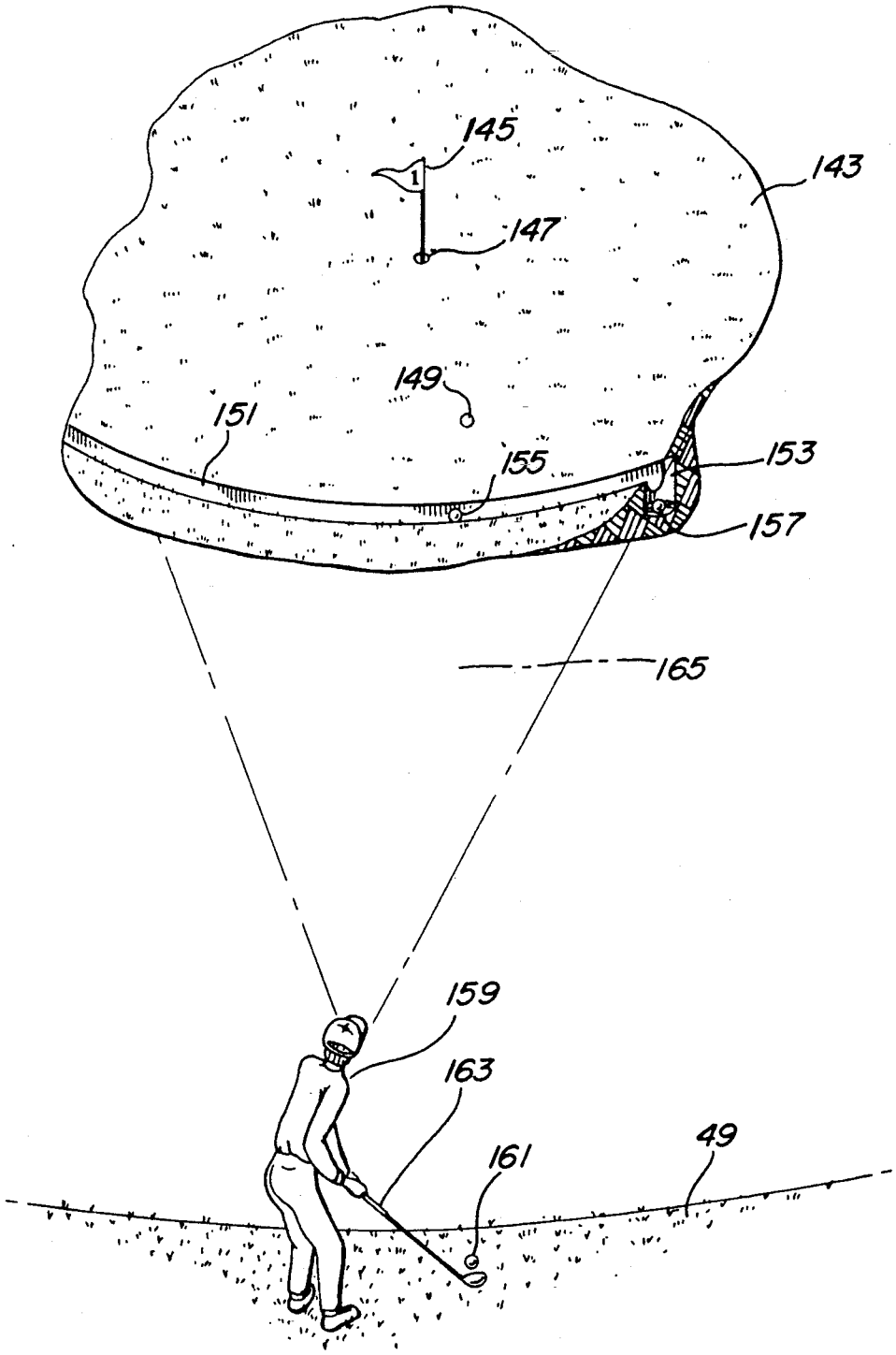
FIG. 3 is a perspective illustration of the construction of a target green with reference to the ball hitting area according to the present invention.
Figure 4:
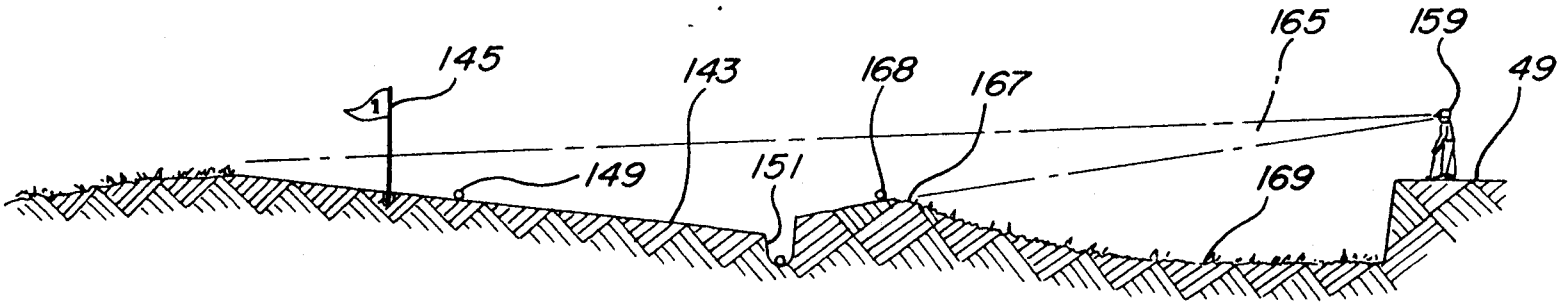
FIG. 4 is a side elevation showing a target green in relation to a player at the ball hitting area.

Before the rules of play and scoring are explained, we will refer to FIGS. 3 and 4 for a more detailed explanation of the construction of each of the target greens and the course itself. This construction is designed to enhance play. As shown in FIG. 3, a player 159 using an appropriate club 163 to hit his ball 161 from a section 49 of the ball hitting area will normally be aiming for a target green 143, which has a pin 145 and a cup 147. His field of view 165 is directed at the green when such a shot is being attempted. In order to make sure that the target green 143 is not full of the balls 149 of previous players, the green is constructed at a slope which causes the balls 149 to slowly roll to a collection receptacle 153. Ball 157 is shown in the collection receptacle.

Referring to FIG. 4, the side view of the target green shows how the green is sloped, but yet not exposed to the player 159 at the ball hitting section 49. A trough 151 is located at the foot of the target green 143 closest to the player 159. Because of a mound 167 located at the foot of green 143 blocking the players vision 165, the trough 151 is not visible to a player located at the ball hitting area 49. A ball falling on target green 143, such as ball 149, will slowly roll towards trough 151. Any ball landing short of target green 143 but beyond mound 167, such as ball 168, will also roll into the trough 151 because of the slight incline into the trough area from mound 167. As a result of this target green construction, every new player will have a fairly ball-free green to shoot at.

To enhance the player's view of the entire playing field, the ball hitting area 49 is slightly elevated above the fairway and the target greens, as shown. Moreover, the fairway 169 is constructed at a slight concave incline to the ball hitting area. This also enhances the player's view of the playing field and target greens.

Prior to starting play, a player will obtain a bucket of 45 balls per nine holes to be played from the clubhouse 111. At that time, he will be assigned to a ball hitting station on the east sections 43, 45 or the west sections 47, 49. The player will then choose a designated drive landing area 19, 17 15 or 20, according to the level of difficulty desired. These landing areas are preferably marked by various colors, such as red, yellow, blue, or black. Each player is allowed 10 practice shots of choice. In other words, they may take 10 drives into the landing areas 19 through 20, or they may take approach shots to the various target greens, or chip shots to the chipping greens.

Upon completing practice, the player will begin the game by playing each hole in the order that the greens are marked. Each hole will be assigned a par, such as par 3, 4 or 5. For all par 4 and par 5 holes, a player will drive to his chosen designated landing area 19, 17, 15 or 20.

Assuming the drive lands in the designated area, the player then drops another ball in his ball hitting section and hits an approach shot to the first green 51. If the ball lands out of bounds, the player drops another ball and tries again. If the ball lands in the designated area, the player hits an approach shot to the first green. If the ball lands outside the designated area or out of bounds again, the player hits an approach shot. If the approach shot lands on the first green 51, the player proceeds to play the next hole.

If the approach shot misses the green and the player's ball lands in bounds and not in a hazard, then the player will drop another ball in his ball hitting section and chip to the chipping green directly in front of his ball hitting section, chipping green 89, 91 or 93, as the case may be.

If the player's approach shot had landed in the sand, the player would be required to drop his ball in a sand trap 95, 97 or 99 adjacent to his ball hitting area and hit to the nearest chipping green from the sand trap.

If the player's approach shot had landed in water 85, the player would simply drop another ball in his ball hitting area and chip to the nearest chipping green 89, 91 or 93, as the case may be.

If the player's ball had landed out of bounds, the player can drop another ball and proceed to hit the other ball to the green, or a player can drop a ball and proceed to chip to the nearest chipping green.

The above sequence of shots is for par 4 and par 5 holes. For each par 3 hole, a player will tee up the ball in the ball hitting area and proceed to hit the ball directly to the target green of the hole being played. The remainder of the shots are played the same as above.

After playing each hole, the player will total the drive and approach shot scores. After all the holes have been played in order and all the drives and approach shot scores have been entered, the player will proceed to the common putting area 101.

The player enters the putting area and proceeds to the putt start area 103. From there, he will putt to the first hole 109. The player will mark down the number of strokes it takes him to get the ball into the cup 110. The player does this for each of the holes in sequence. Upon completing the putting sequence, the player simply adds the drive and approach shot scores with the putting score to obtain a total game score for nine holes.

A player may wish to play a simulated 18-hole game. He can be accommodated on the layout of FIG. 1 simply by changing to the opposite side of the ball hitting section from which he played the first nine holes and repeating the above procedure.

Referring now to FIG. 2, the scorecard for marking down the players' scored according to the rules of the game of the present invention is illustrated. The scorecard 115 is divided into a plurality of columns. Column 1 accommodates a plurality of columns. Column 1 accommodates a plurality of players whose names are entered in sections 117, 119, 121, and 123, for example. Across the top of the scorecard is listed the number of the hole. Beneath the number is listed the par rating of that hole. Beneath that, if desired, the designated yardage of that hole may be listed.

Each hole has its own column which accommodates, for each player, the number of drives, which would be entered in block 125 for player 117, the number of approach shots, which would be entered in block 127 for player 117, and the number of putts, which would be entered in block 129 for player 117, to come up with the total strokes taken for that hole, which would be entered in block 131 for player 117. The approach shot block 127 for a par 4 hole, like hole #1, would include all the chip shots. For a par 3 hole, like hole #6, for example, the approach shot is the drive, and any chip shots, plus drive shots would be located in block 134. Block 133 would not be used. The last column on the scorecard 115 is a totals column. Block 135 would contain the total drives. Block 137 would contain the total approach shots. Block 139 would contain the total putts. The total strokes for the nine holes would be placed in block 141.

Scoring the golf game according to the present invention is accomplished as follows. The player chooses his designated landing area according to the level of difficulty desired; in other words, landing sections 19, 17, 15 or 20. For the par 4 and par 5 holes the player drives his ball to these landing areas. If the player's ball lands in the chosen landing area, the player scores the drive as one stroke. If the player's ball lands in a sand trap or misses the designated landing area, the player's drive is counted as two strokes. If the player's drive lands in water, the player's drive counts as three strokes.

If the drive lands out of bounds, the player may drive another all. If the second ball lands in the designated area, the drive is scored as three strokes. If the second ball lands outside the designated area, the drive is scored as four strokes. If the second ball lands out of bounds again, the drive is scored as five strokes.

The next shot to be taken in a par 4 or par 5 hole is the approach shot. The player drops another ball and proceeds to play the particular target green for the hole being played. If the player's ball lands on the target green being played, the approach shot counts as one stroke. If the player's ball lands in the hole of the target green, the player counts one stroke and scores a zero in the applicable square for the putt. If the player's ball misses the green but lands near the green and in bounds, the player will need to drop another ball and chip to his designated chipping green directly in front of his ball hitting area. If the ball lands on the chipping green, the player counts two strokes. If the player's ball misses the chipping green, the player counts three strokes and proceeds to play the next green. Thus, either two or three strokes is entered into the approach shot box.

However, assume on the initial approach shot the player's ball lands in sand. As a result, the player will need to drop a ball in the sand trap adjacent to his ball hitting area and hit from that sand trap to the designated chipping green in front of his ball hitting area. If, by hitting from the sand trap, the player's ball lands on the green, the player counts two strokes for his approach shots. If the shot from the sand trap misses the green, the player counts three strokes for his approach shot. If the shot from the sand trap fails to get out of the sand trap, as sometimes may be the case, the player is allowed to try again. If the player's second attempt to get out of the sand trap lands on the green, the player counts three strokes for his approach. If the player's second attempt misses the green, the player counts four strokes for his approach and returns to the tee area of his ball hitting section to proceed to play the next hole.

Assume now that during an approach shot, a player's ball lands in water. The player will drop another ball and chip to his designated chipping green directly in front of his designated ball hitting area. If this chip shot lands on the green, the player counts three strokes for his approach If this chip shot misses the green, the player counts four strokes for his approach and proceeds to play the next hole.

Assuming that in his approach, the player lands out of bounds, beyond the boundaries to the right 31, 33 or to the left 35, 37, the player may attempt another tee shot, or may drop another ball and chip to his nearest chipping green. If the player lands on the chipping green, he counts four approach shots. If the player misses the chipping green, he counts five strokes for his approach and proceeds to play the next hole.

The above description of scoring for approach shots on par 4 and par 5 holes is also the description of scoring for all par 3 holes, except that the drive on a par 3 hole is directly to a target green. In other words, the approach shot of a par 4 hole, wherein the player is aiming for a target green, becomes the drive in a par 3 hole.

After a player has hit balls to all nine target greens in the order marked, the drives and approach shots will be totalled in the right-hand column on the scorecard.

The player will then proceed to the putting green, where he will start to putt to hole #1 from the designated starting area. After he has putted all nine holes in sequence, the number of strokes required to sink the ball into the cup for each hole is marked in the appropriate column. After he has putted all nine holes in sequence, the approach shot and drive scored are totalled with the total putting score to arrive at the total game score.

An alternate preferred embodiment to the foregoing described invention includes a modification of which will considerably enhance the pleasure and competitive play of the individual players. Referring first to FIG. 5, a target green 181 is illustrated as having a cup 185 and a pin 183 located therein. Three distinctly marked putting zones A, B, and C, are located around cup 185 extending outwardly from cup 185. The surrounding area outside of putting zone C can be considered to be another putting zone D. The purpose behind these zones is to give the player who is remotely located from target green 181 a clear idea of how far from pin 183 his ball is located.

In those instances where the target green 181 is so far in the distance, the player cannot see the putting zones distinctly. The invention contemplates mounting a video camera 177 in a nearby obstacle such as tree 175. Video camera 177 would be focused and aimed to cover the entire green 181.

The video signals from video camera 177 as well as video signals from other video cameras (not shown) that may be located at other target greens would be fed to monitors 199 and 205 (FIG. 6) located at the tee area. A particular player such as player 197, for example, could select by appropriate means on monitor 199 which particular target green he wanted displayed depending on the hole he was playing.

In those instances when a player's drive or approach shot does not hit a target green such as target green 181, a chip shot would be required. A player such as 197 would then drop a ball 201 in the tee area and chip to his respective chipping green, and hole. The chipping green 187 is set up in front of the tee area and can accommodate at least players 197 and 203. Player 197 would chip his ball 201 to cup 193 located by flag 189. Player 203 would chip his ball 207 to cup 195 located by flag 191. Each flag, both 189 and 191, are distinctly marked into the putting zones A, B and C which range from the cup outwards. The unmarked area surrounding the marked putting zones can be considered putting zone D. Here again, the idea is to quickly advise the players, 197 and 203, how close to their respective pins 189, 191 their balls landed as a result of their chip shot.

Upon reaching a green with the ball, whether it is a target green 81 or a chipping green 187, for example, and noting which putting zone the ball landed within, a player would mark that zone for that hole on his scorecard. The scorecard of FIG. 2 and specifically "puts" line 129 would be modified as follows:

| HOLE / PUTTS / ZONE | 1 | 2 | 3 | ... |
|---|---|---|---|---|
| | | | | |

As can be seen, for each hole the player simply marks in the lower half of the box for that hole which putting zone, A, B, C or D, he landed in. The number of putts taken to get from that zone into the cup will be determined at the putting green.

Figure 7:
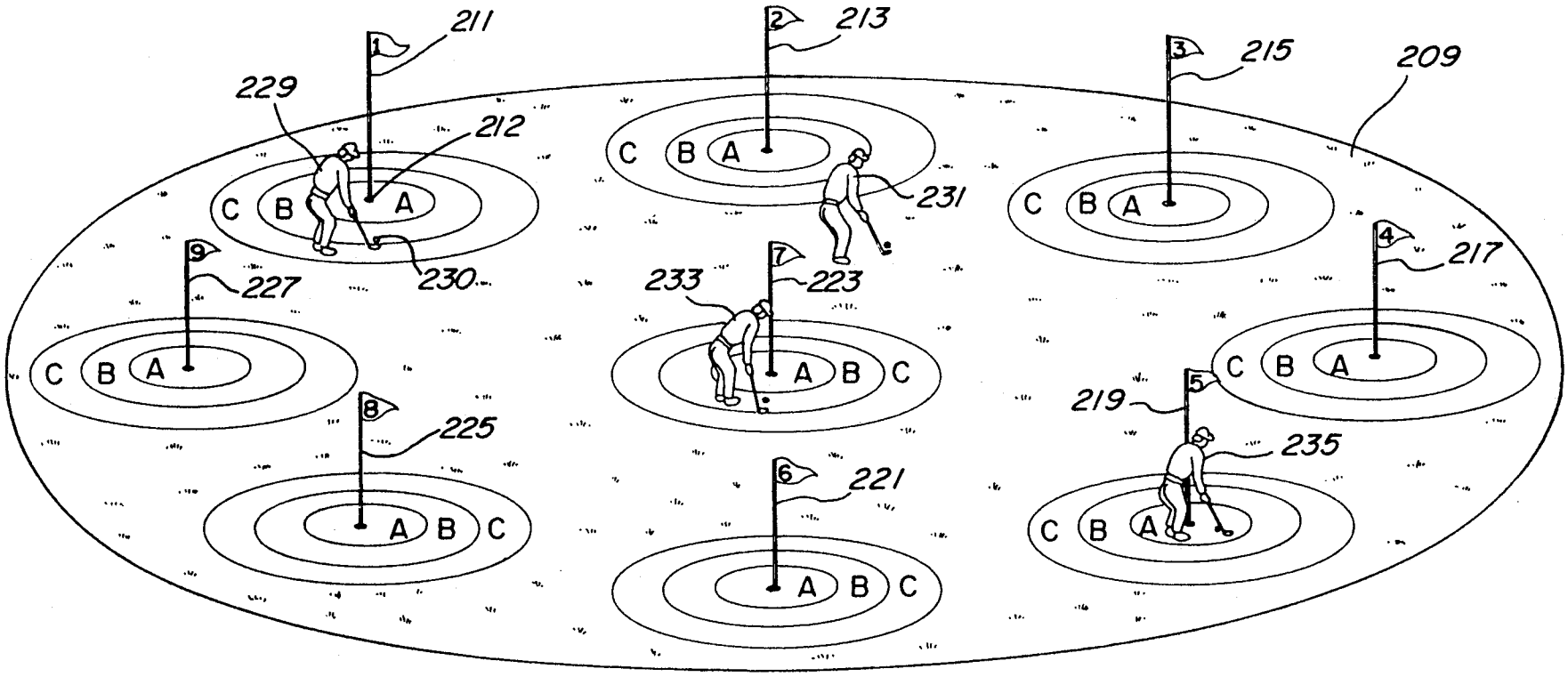
FIG. 7 is a perspective illustration of an alternate preferred embodiment of a putting green showing each hole on the putting green marked into distinct putting zones ranging outwardly from the cup.

According to this alternate preferred embodiment, the putting green 209 (FIG. 7) is modified to contain a plurality of holes 1 through 9 with putting zones A, B and C distinctly marked thereon.

Putting green 209 is illustrated as having 9 separate putting holes. Putting hole 1 has pin 211 marking it. Located around the cup 212 are putting zones A, B and C. Player 229 is shown putting out at hole 1 with his ball 230 located on the outer edge of putting zone B. This would be the location at which he landed on one of the target greens or one of the chipping greens.

Putting hole 2 is marked by flag 213. Player 231 is shown putting out at hole 2 from outside putting zone C in the general putting zone area D (not marked).

Hole 3 is marked by pin 215. It also has likewise as putting zones A, B and C marked theraround. Although the putting zones are indicated as being circles around the cup, having ever increasing diameter, it should be understood that these putting zones may be other convenient shapes, as desired, to follow the contours of target greens or chipping greens.

Hole 4 is marked by flag 217. Hole 5, which is marked by flag 219, shows a player 235 putting out from putting zone A. Hole 6 is marked by flag 221. Hole 7 is marked by flag 223. Player 233 is shown putting out at hole 7 with his ball located on the inside of putting zone B. Hole 8 is marked by flag 225. Hole 9 is marked by flag 227.

In this manner, a unique competitive style of gold game can be played on a compact and picturesque golf course, giving the utmost pleasure to the individual players.

What is claimed is:

1. A method of playing a golf game on a compact golf course having an elongated fairway with a plurality of distinct distance markers representing drive landing areas, a plurality of target greens with water or sand hazards associated therewith located in the fairway with at least one of said target greens being remote from said drive landing areas, each target green having a cup there a ball hitting area at one end of said fairway with a plurality of sand traps located adjacent thereto, a plurality of chipping greens located in said fairway in close proximity to said ball hitting area, and a single putting green containing a plurality of flags and associated cups thereon, with the putting green having an equal number of flags and cups as there are target greens, with each flag being sequentially numbered, said method comprising:

selecting a spot on said ball hitting area from which a plurality of balls for a plurality of holes will be hit;

designating one of said drive landing areas and a target greens corresponding to a hole being played, each hole having a different one of said target greens associated therewith;

driving a first ball from the ball hitting area toward the drive landing area for the hole being played;

regardless of whether the drive to the drive landing area reaches the drive landing area, hitting an approach shot using a second ball from the ball hitting area toward the target green corresponding to the hole being played;

playing the next hole of the plurality of holes in order if the approach shot lands on the target green;

chipping a third ball from the ball hitting area toward the adjacent chipping green if the approach shot does not land on the target green;

chipping a third ball from the adjacent sand trap toward the adjacent chipping green if the approach shot to the target green lands in one of said sand hazards;

chipping a third ball from the ball hitting area toward the adjacent chipping green if the approach shot to the target green lands in one of said water hazards, and playing all remaining holes of the plurality of holes in the above manner, then putting sequentially to each of the cups on the putting green.

2. The method of claim 1 further comprising a method of scoring as follows:

if the drive shot lands in a designated drive landing area, the drive shot counts as one stroke, if the drive lands in the sand hazard or fails to reach the designated drive landing area, the drive shot counts as two strokes, if the drive land in the water hazard, the drive counts as three strokes;

if the approach shot lands on the target green, the approach shot counts as one stroke, if the approach shot lands in the cup of the target green, the approach shot counts at one stroke and a zero putt is counted for that hole; if the approach shot misses the target green and a player chips to an adjacent chipping green and the chip shot lands on the chipping green, the approach shot counts as two strokes, and if the chip shot misses the chipping green, the approach shot counts as three strokes; and the putts for the holes, putted sequentially on the putting green are totalled and added to the counted strokes.

3. The method of scoring of claim 2 wherein the scoring further comprises:

if the approach shot lands in the sand hazard, such that the chip shot is taken from the adjacent sand trap, and the chip shot lands on the target green, the approach shot counts as two strokes, and if the approach shot lands in the cup on the target green, the approach shot counts as two strokes and a zero putt is counted, and if the chip shot misses the target green, the approach shot counts as three strokes and if the chip shot stands in the sand trap, a second shot is taken from the sand trap which counts three strokes if second shot lands on the chipping green, or four strokes if second shot misses the chipping green.

4. The method of scoring of claim 3 wherein the scoring further comprises:

if the approach shot lands in the water hazard, such that, the chip shot is taken from the ball hitting area to the adjacent chipping green, and if the chip shot lands on the target green, the approach shot counts as three strokes, and if the chip shot misses the target green, the approach shot counts as four strokes.

5. The method of scoring of claim 4 wherein the scoring further comprises:

if the approach shot lands out of bounds, another approach shot is taken to the target green, or a further ball is played from the ball hitting area to the nearest chipping green, if the further ball lands on the target green, the further approach shot counts as four strokes, if the further ball misses the target green, the approach shot counts as five strokes.

6. The method of scoring of claim 5 wherein the scoring further comprises:

if the drive slot lands out of bounds, the player drops a second ball to drive;

if the second ball lands in the designated area, the approach shot counts as three strokes, if the second ball lands in bounds but outside the designated area, the approach shot counts as four strokes, if the second ball lands out of bounds, the approach shot counts as five strokes.

7. A method of playing a golf game on a compact golf course having an elongated fairway with a plurality of distinct distance markers representing drive landing areas, a plurality of target greens with water or sand hazards associated therewith located in the fairway, with at least one of said target green being remote from said drive landing areas, each target green having a cup disposed therein and being marked with distinct putting zones ranging from the cup outward, a bal hitting area at one end of said fairway with a plurality of sand traps located adjacent thereto, a plurality of chipping greens located in said fairway in close proximity to said ball hitting area, and a single putting green containing a plurality of flags and associated cups thereon, with the putting green having an equal number of flags and cups as there are target greens, with each flag being sequentially numbered, the putting green being marked with putting zones ranging from the cup outward, said putting zones being of the same size and shape as the putting zones of the target greens, said method comprising:

selecting a spot on said ball hitting area from which a plurality of balls for a plurality of holes will be hit;

designating one of said drive landing areas and one of said target greens corresponding to a hole being played, each hole having a different one of said target green associated therewith;

driving a first ball from the ball hitting area toward the designated drive landing area for the hole being played;

regardless of whether the drive to the drive landing area reaches the drive landing area, hitting an approach shot using a second ball from the ball hitting area toward the target green corresponding to the hole being played;

recording the putting zone in which the approach shot lands, if the approach shot lands on the target green;

playing the next hole of the plurality of holes in order if the approach shot lands on the target green;

chipping a third ball from the ball hitting area toward the adjacent chipping green if the approach shot does not land on the target green;

chipping a third ball from the adjacent sand trap toward the adjacent chipping green if the approach shot to the target green lands in one of said hazards;

chipping a third ball from the ball hitting area toward the adjacent chipping green if the approach shot to the target green lands in one of said water hazards; and playing all remaining holes of the plurality of holes in the above manner, then putting sequentially to each of the cups on the putting green, each putt starting from within the putting zone recorded for the corresponding target green.

8. A method of playing a golf game on a compact golf course having an elongated fairway with a plurality of distinct distance markers representing drive landing areas, a plurality of target greens with water or sand hazards associated therewith located in the fairway, with at least one of said target greens being remote from said drive landing areas, a video camera mounted in proximity to each of said target greens for capturing the image of each target green, each target green having a cup disposed therein and being marked with distinct putting zones ranging from the cup outward, a ball hitting area at one end of said fairway with a plurality of sand traps located adjacent thereto, a video monitor located at said ball hitting area for displaying the images of the target greens, a plurality of chipping greens located in said fairway in close proximity to said ball hitting area, and a single putting green containing a plurality of flags and associated cups thereon, with the putting green having an equal number of flags and cups as there are target greens, with each flag being sequentially numbered, the putting green marked with putting zones ranging from the cup outward, said putting zones being of the same size and shape as the putting zones of the target greens, said method comprising:

selecting a spot on said ball hitting area from which a plurality of balls for a plurality of holes will be hit;

designating one of said ball drive landing areas and one of said target greens corresponding to a hole being played;

driving a first ball from the ball hitting area toward the designated distance marker for the hole being played;

regardless of where the drive to the drive landing area reaches the drive landing area, hitting an approach shot using a second ball from the ball hitting area toward the target green corresponding to the hole being played;

viewing the approach shot on the video monitor to determine whether the approach shot lands in one of the putting zones;

recording the putting zone in which the approach shot landed, if the approach shot reaches the target green;

playing the next hole of the plurality of holes in order if the approach shot lands on the target green;

chipping a third ball from the ball hitting area toward the adjacent chipping green if the approach shot does not land on the target green;

chipping a third ball from the adjacent sand trap toward the adjacent chipping green if the approach shot to the target green lands in one of said sand hazards;

chipping a third ball from the ball hitting area toward the adjacent chipping green if the approach shot to the target green lands in one of said water hazards and playing all remaining holes of the plurality of holes in the above manner, then putting sequentially to each of the areas on the putting green, each putt starting from within the putting zone recorded for the corresponding target green.

9. A method of playing a golf game on a compact golf course having an elongated fan-shaped fairway with a plurality of distinct distance markers representing drive landing area at a central extreme end of the fairway for indicating the length of a drive; a ball hitting area at an end opposite the central extreme end of said fairway from which all shots are taken, said area having a plurality of tee sections; at least nine target greens, each green having a flag and a cup located throughout said-fan-shaped fairway at different distances and at different horizontal projections from each one of said tee sections of said ball hitting area; a water hazard or a sand trap associated with each of said target greens; a plurality of chipping greens located in front of and in close proximity to said ball hitting area, each of said chipping greens having a plurality of cups with a flag therein; a plurality of sand traps located in front of said ball hitting area and behind said plurality of chipping greens; a plurality of trees scattered throughout said fan-shaped fairway; a stream running across said fan-shaped fairway with a small lake in the center thereof almost completely surrounding one of said target greens; and a single putting green containing the same number of flags and cups as there are target greens, and having a single start to putt area in the center thereof, said putting green located in an area adjacent to said ball hitting area, said method comprising:

selecting a spot on said ball hitting area from which a plurality of balls for a plurality of holes will be hit;

designating one of said ball drive landing areas and one of said target greens corresponding to a hole being played;

driving a first ball from the ball hitting area toward the drive landing area for the hole being played;

regardless of whether the drive to the drive landing area reaches the drive landing area, hitting an approach shot using a second ball from the ball hitting area toward the target green corresponding to the hole being played;

playing the next hole of the plurality of holes in order if the approach shot lands on the target green;

chipping a third ball from the ball hitting area toward the adjacent chipping green if the approach shot does not land on the target green;

chipping a third ball from the adjacent sand trap toward the adjacent chipping green if the approach shot to the target green landed in one of said sand hazards;

chipping a third ball from the ball hitting area toward the adjacent chipping green if the approach shot to the target green lands in one of said water hazards; and playing all remaining holes of the plurality of holes in the above manner, then putting sequentially to each of the cups on the putting green.

* * * * *